United States Patent [19]

Nagan et al.

[11] Patent Number: 4,832,105

[45] Date of Patent: May 23, 1989

[54] INVESTMENT CASTING METHOD AND APPARATUS, AND CAST ARTICLE PRODUCED THEREBY

[75] Inventors: Raymond M. Nagan, River Vale, N.J.; Antulio D. Marrero, Amawalk, N.Y.; Rajeev V. Naik, Garfield; Victoria Gleyzer, New Milford, both of N.J.

[73] Assignee: The Interlake Corporation, Oak Brook, Ill.

[21] Appl. No.: 143,339

[22] Filed: Jan. 13, 1988

[51] Int. Cl.[4] ..... B22D 18/00

[52] U.S. Cl. ..... 164/61; 164/134; 164/256

[58] Field of Search ..... 164/134, 358, 61, 62, 164/63, 65, 66.1, 253, 254, 256, 259

[56] References Cited

U.S. PATENT DOCUMENTS

| | | | |
|---|---|---|---|
| 2,756,138 | 7/1956 | Meister | 164/61 |
| 3,396,935 | 8/1968 | Snyder | 164/138 |
| 4,597,431 | 7/1986 | Hobo et al. | 164/253 |

FOREIGN PATENT DOCUMENTS

| | | | |
|---|---|---|---|
| 61-176441 | 8/1986 | Japan | 164/134 |
| 61-229462 | 10/1986 | Japan | 164/134 |
| 831335 | 5/1981 | U.S.S.R. | 164/138 |

*Primary Examiner*—Kuang Y. Lin

*Attorney, Agent, or Firm*—Samuelson & Jacob

[57] ABSTRACT

Method and apparatus for producing an investment casting from molten material by filling a cavity in a mold with the molten material utilizing at least one porous member in the inlet conduit system of the mold, the porous member enabling evacuation of the mold cavity, through the inlet conduit system and the porous member, and having a structure including pores small enough subsequently to support the molten material upon the porous member by surface tension, with the molten material closing off essentially all atmospheric communication between the inside and the outside of the mold cavity, to thereby prevent passage of the molten material into the mold cavity until the method and apparatus subsequently raises the pressure outside the mold to provide a higher pressure outside the mold cavity and create a differential pressure between the inside and the outside of the mold cavity sufficient to overcome the surface tension and urge the molten material to pass through the pores of the porous member and fill the mold cavity for subsequent cooling and solidification to complete the casting.

27 Claims, 3 Drawing Sheets

INVESTMENT CASTING METHOD AND APPARATUS, AND CAST ARTICLE PRODUCED THEREBY

The present invention relates generally to the art of casting and pertains, more specifically, to an improvement in producing cast articles through the use of investment casting techniques and apparatus.

Investment casting has been developed to the point where it now is commonplace to produce a wide variety of articles, including many having highly complex configurations, utilizing investment casting processes. Among the more desirable aspects of the investment casting process is the ability to produce detailed, completed parts, including parts of complex configuration, without requiring intricate machining or expensive forging procedures. It has been suggested that improved investment castings could be attained by employing a pressure differential to assist in filling the cavity of the mold utilized in the investment casting process. Thus, U.S. Pat. No. 4,478,270 discloses apparatus in which a mold cavity in a gas-permeable mold is evacuated and a mechanical stopper closes the mold cavity until the stopper is withdrawn and a pressure differential assists the flow of molten material into the mold cavity. In European patent application No. 82303945.8, published on Feb. 9, 1983, under publication No. 0 071 449, there is disclosed the use of a gas-impermeable mold formed around a fiber array which is to become a part of the completed cast article. The flow of molten material into the mold, and into the interstices within the fiber array, is assisted by simultaneously applying vacuum at one end of the mold and pressure at the other end. An article appearing in Volume 11 B, at pages 39 through 50, of METALLURGICAL TRANSACTIONS B, published by the American Society for Metals and the Metallurgical Society of AIME, dated March 1980, teaches that an aggregate of nonwettable refractory particles can act as an off-on valve to control the flow of liquid metals and illustrates a casting procedure in which the simultaneous application of pressure and vacuum exceeds the pressure which can be supported by the off-on valve and assists in the filling of the cavity in a gas-permeable mold. The present invention places porous means, preferably in the form of at least one porous member, in the inlet conduit system of a gas-impermeable investment casting mold so that the mold cavity first can be evacuated through the porous means and then ca be closed by molten material resting against the porous means to maintain the evacuated condition of the mold cavity until the pressure is raised outside the mold cavity to create a pressure differential sufficient to urge the molten material through the porous means and into the mold cavity.

Accordingly, the present invention provides method and means by which articles of enhanced qualities may be produced by investment casting, and exhibits several objects and advantages, some of which may be summarized as follows: Improved filling of the cavity of the mold in which a casting is produced, through the use of a pressure differential to force molten material into the mold cavity, thereby enabling enhanced definition of the configuration of the cast article, in a simplified apparatus; increased cleanliness through the removal of inclusions in the molten material prior to entry into the mold cavity; enhanced soundness in the cast article by virtue of the elimination of voids in the finished product; a finer grained microstructure obtained as a result of the ability to pour molten material at relatively lower temperatures while still filling the mold cavity; improved mechanical properties in the completed cast article; economical use of casting materials in that less material is required for producing a particular item, and the yield of usable parts is increased; the ability more readily to cast more complex parts, enabling a reduction in design and development time for new parts; increased performance and reliability in cast parts, leading to more widespread use of cast parts for components heretofore manufactured by other methods, such as forging and machining; and more economical manufacture of a wider variety of parts of consistent high quality and exemplary performance.

The above objects and advantages, as well as further objects and advantages, are attained by the present invention which may be described briefly as the method of and apparatus for investment casting an article from molten material by filling a cavity in a mold with the molten material for subsequent cooling and then breaking away of the mold for removal of the article from the mold, the mold having passages therein providing essentially all of the communication between the inside of the mold cavity and the outside of the mold cavity, the method and apparatus comprising: the step of and means for essentially evacuating the mold cavity through the passages; the step of and means for subsequently introducing the molten material into the mold and retaining the introduced molten material juxtaposed with the passages outside the mold cavity with a retaining force sufficient to maintain the molten material outside the mold cavity and in such juxtaposition with the passages that the molten material itself closes essentially all atmospheric communication between the inside and the outside of the mold cavity; and the step of and means for then raising the pressure outside the mold to establish a pressure outside the mold cavity higher than the pressure inside the mold cavity, while maintaining all atmospheric communication between the inside and the outside of the mold cavity essentially closed, to create a pressure differential between the inside and the outside of the mold cavity at least sufficient to overcome the retaining force and urge the molten material through at least some of the passages to pass into and fill the mold cavity for subsequent cooling and solidification of the molten material and completion of the investment cast article. Preferably, the passages are provided by porous means in the mold, the porous means advantageously being in the form of a porous member having pores small enough so that surface tension provides the retaining force to support the molten material in the desired juxtaposition with the passages. In a preferred configuration, the mold includes an inlet conduit system communicating with the mold cavity and through which the molten material is passed to fill the mold cavity, and the passages communicate with the inlet conduit system.

The invention will be understood more fully, while still further objects and advantages will become apparent, in the following detailed description of preferred embodiments thereof illustrated in the accompanying drawing, in which.

Figure 1:
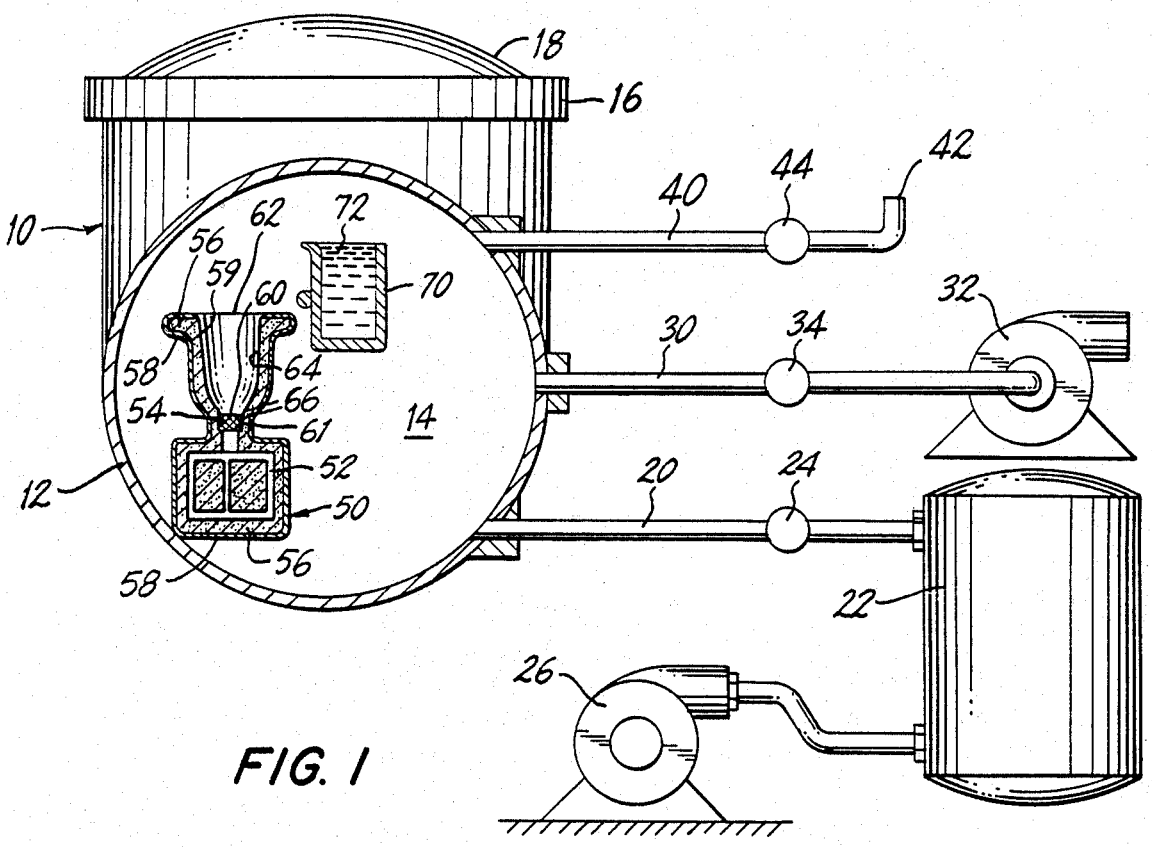
FIG. 1 is a partially diagrammatic cross-sectional view of an apparatus constructed in accordance with the invention, and illustrating the method of the invention.

Referring now to the drawing, and especially to FIG. 1 thereof, an apparatus constructed in accordance with the invention is illustrated generally at 10 and is seen to include a pressure vessel 12 having a chamber 14 with an opening 16 closed by a selectively removable cover 18. A pressure supply line 20 communicates with the chamber 14 and with a source of high-pressure gas in the form of an accumulator 22, through a supply valve 24. A supply pump 26 provides the desired elevated pressure in the accumulator 22, which elevated pressure preferably is in the range of multiple atmospheres. Alternately, high pressure gas may be supplied from tanks of pressurized gas. A vacuum line 30 also communicates with chamber 14 and is connected to a vacuum pump 32, through a vacuum valve 34. A vent line 40 communicates with the chamber 14 and is vented to the ambient atmosphere at 42, through a vent valve 44.

Placed within the chamber 14 is a mold 50 having a mold cavity 52 in the form of an article to be cast. An inlet conduit system which includes an inlet conduit 54 interconnects the inside of the mold cavity 52 with the outside of the mold 50, and the cavity 52 thereof, and provides for the ingress of molten material into the mold cavity 52, as will be explained in detail below. In the illustrated embodiment, the mold 50 is essentially gas-impermeable; that is, although the walls 56 of the mold 50 are constructed of a refractory material suitable for casting a part from the selected molten material, which refractory material can be somewhat permeable, layers 58 and 59 of essentially impermeable material are added in order to render the walls 56 suitably impermeable. Porous means in the form of a porous member 60 is placed within the inlet conduit 54, and is seated upon a shoulder 61 within inlet conduit 54, below the mouth 62 of the inlet conduit 54 and above, but closely adjacent to the inlet cavity 52, at the base of the pouring cup 64 of the mold 50. The porous member 60 includes a multiplicity of passages in the form of pores 66 and is fitted into the inlet conduit 54 so that all ingress into and egress out of the cavity 52 is through the pores 66 of porous member 60.

A crucible 70 is located adjacent mold 50 and contains a charge of molten material 72 which will be utilized to cast the desired article. The mold 50 and the crucible 70 are placed within the chamber 14 through opening 16 and access to the components in the chamber 14 is gained through opening 16. With the cover 18 in place and with valves 24, 34 and 44 closed, chamber 14 is sealed. Valve 34 then is opened to essentially evacuate chamber 14 and the pressure in the chamber 14 is lowered. At the same time, mold cavity 52 is essentially evacuated so that gas is removed from the mold cavity 52 and the pressure within mold cavity 52 is lowered, by virtue of the atmospheric communication between the mold cavity 52 and chamber 14 through the porous member 60. It is noted that the charge of molten material 72 may be placed in the crucible 70 prior to closing and sealing the chamber 14, or may be formed after the pressure in chamber 14 is lowered, by melting material in the crucible 70 after the chamber is sealed and the pressure therein lowered. Valve 34 is closed subsequent to such evacuation of the chamber 14 to maintain the lowered pressure in the vessel 12.

Figure 2:
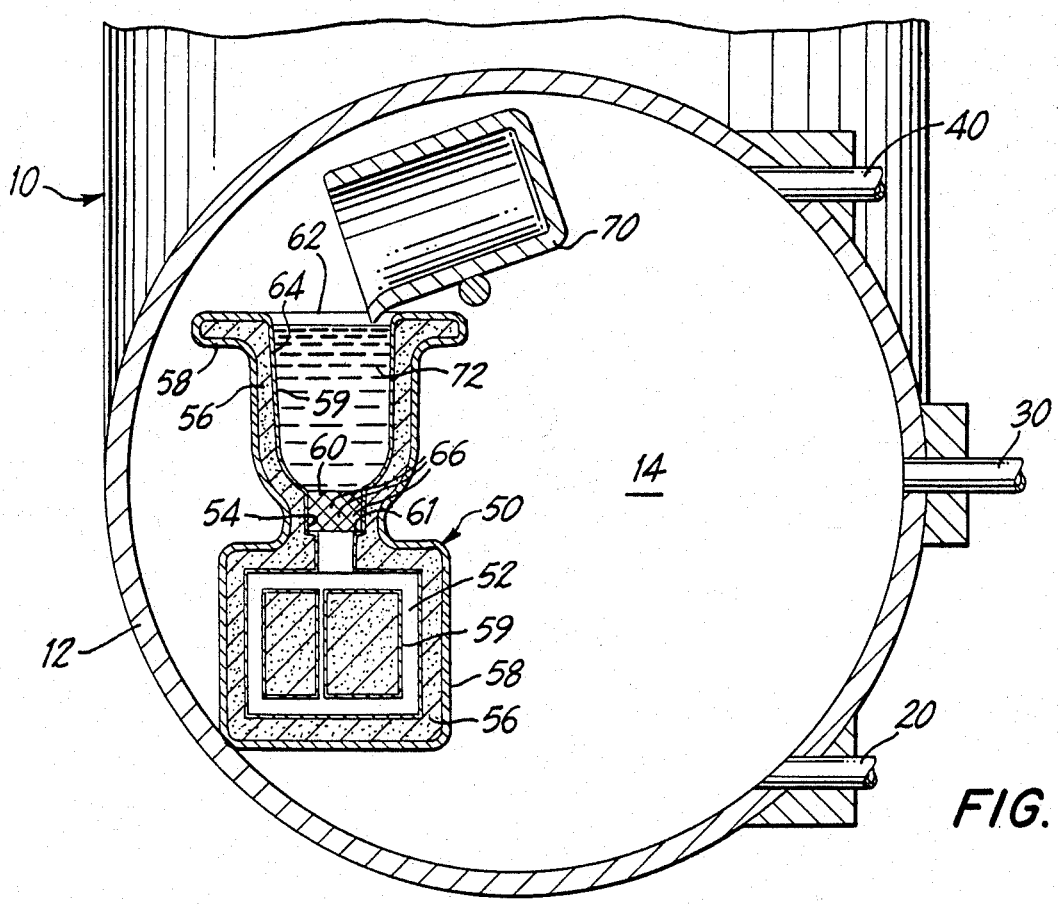
FIG. 2 is an enlarged fragmentary view of a portion of FIG. 1, with the components of the apparatus in another operating position, showing another step of the method.
Figure 3:
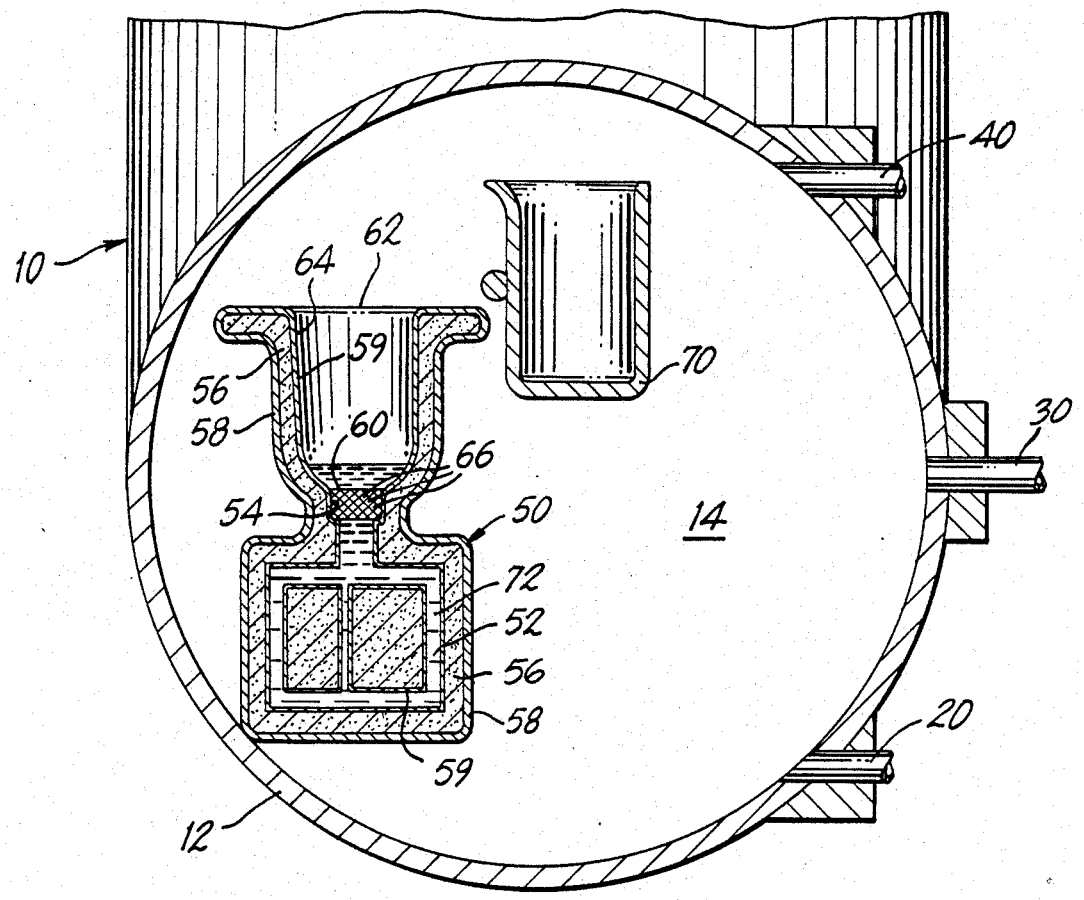
FIG. 3 is a view similar to FIG. 2, with the components of the apparatus in still another operating position.
Figure 4:
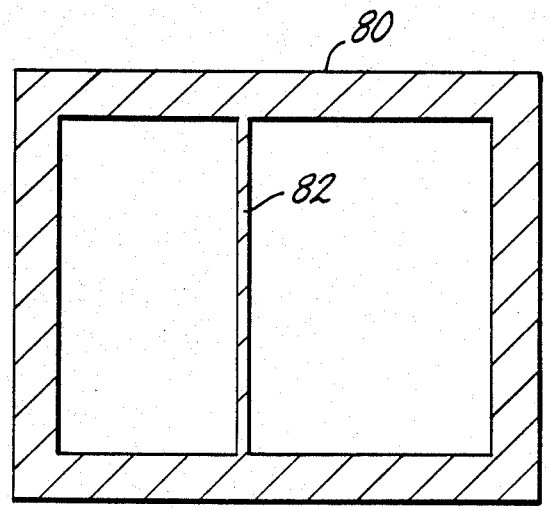
FIG. 4 is a cross-sectional view of an article produced in the illustrated apparatus, utilizing the method of the invention.

Turning now to FIG. 2, while the pressure in chamber 14 is maintained lowered, the molten material 72 is poured from crucible 70 through the mouth 62 of mold 50, into the pouring cup 64 and onto the porous member 60 where the molten material 72 rests against the porous member 60. The pore size of the pores 66 in porous member 60 is such that surface tension supports the molten material 72 juxtaposed with the porous member 60, and the molten material 72 is prevented from passing through the porous member 60 into cavity 52 and is retained in the pouring cup 64. At this stage of the procedure, the molten material 72 serves as a seal which closes off atmospheric communication between the mold cavity 52 and chamber 14 of the vessel 12. Upon completion of the pouring of the molten material 72 into the pouring cup 64, and with valve 34 closed, valve 24 is opened to raise the pressure within chamber 14 to a pressure higher than the pressure inside the mold cavity 52, thereby creating a pressure differential between the inside and the outside of the mold cavity 52 at least sufficient to overcome the surface tension which supports the molten material 72 on the porous member 60. As best seen in FIG. 3, The molten material 72 thus is driven through the porous member 60 and fills the cavity 52. When the molten material 72 has cooled, and subsequent to closing valve 24 and opening valve 44 to return the pressure within chamber 14 to atmospheric pressure, cover 18 is removed and the mold 50 is withdrawn from the chamber 14 of vessel 12, through opening 16, and is broken away from the solidified material to release the completed cast article 80, illustrated in FIG. 4.

In the preferred embodiment described above, the pressure within the chamber 14 is lowered, prior to pouring the molten material 72 from the crucible 70 into the pouring cup 64, to a desired vacuum level. For example, a vacuum pressure level between 1 and 2 mm of mercury has been found adequate for casting with aluminum alloy materials. Even higher levels of vacuum, such as 1 to 100 microns of mercury, are appropriate for casting with superalloy materials and with steel. At such levels of vacuum, the mold cavity 52 of the mold 50 essentially is evacuated, enabling rapid and complete filling of the cavity 52 with molten material, without the presence of pockets of gas which could lead to voids within the completed part and which could affect the definition of the contours and surface finish of the completed cast article 80. Thus, more detailed and intricate configurations are made possible in parts cast with increased ease, and the internal soundness of the cast parts is improved. In the illustrated embodiment, both the mold 50 and the molten material 72 in crucible 70 are placed within the chamber 14 prior to evacuation of the chamber 14; however, melting may be accomplished within the chamber 14, if desirable in particular production operations.

The pressure in chamber 14 is raised, subsequent to the pouring of molten material 72 into pouring cup 64, to a level at least sufficient to urge the molten material 72 to pass through the porous member 60, and to do so with rapidity. Preferably, the pressure in the chamber 14 is raised to a pressure level above normal atmospheric pressure, and into the range of multiple atmospheres. The pressurizing medium may be air or an inert gas, such as nitrogen, or a combination of inert gases, as may be appropriate in connection with casting with particular casting materials. The combination of evacuation and then pressurization enables the manufacture not only of more intricate and detailed castings, but castings having relatively thin walls of a wider expanse and a soundness not available readily in prior methods. Thus, wall 82 of the completed cast article 80 is seen to have a relatively thin cross-section, and extends over a relatively wide area, yet is free of voids and other discontinuities, and is mechanically sound. Thin wall castings of 0.030 inch wall thickness or even thinner are made possible with the present process and apparatus.

The porous member 60 serves several functions: First, the porosity of porous member 60 enables evacuation of the mold cavity 52 through the inlet conduit 54 and the porous member 60 itself, enabling the use of a completed, easily constructed gas-impermeable mold 50 placed within a single chamber 14. Then, the porous member 60 supports the molten material 72, as illustrated in FIG. 2, and serves as a valve establishing the seal which closes off atmospheric communication between the evacuated mold cavity 52 and the chamber 14 so that the pressure in chamber 14 can be reversed, subsequent to the evacuation of chamber 14 and pouring of the molten material 72, to establish the desired pressure differential. In this manner, the apparatus is simplified in that only a single chamber is required for carrying out the entire process. Further, the porous member 60 serves as a filter in that unwanted inclusions are removed from the molten material 72 as the molten material passes through the porous member 60. For example, where the molten material is a metal alloy, such inclusions as oxides and unmelted alloy constituents will be prevented from entering the mold cavity 52 and contaminating the completed cast article 80.

In the investment casting of metal alloys, such as aluminum alloys, stainless steel, cast iron and other nonferrous or ferrous alloys, the mold 50 is constructed of a refractory material. Typical mold materials are refractories such as zircon, silica, aluminum-silicates and colloidal silica-plus-water. Since shell molds constructed of these materials can be permeated by gases, the mold walls 56 are seal coated with an essentially gas-impermeable material, usually in the form of very fine refractory material applied as a slurry, such as a zircon, silica, or alumina slurry to form suitably impermeable seal coating layers 58 and 59. At lower mold temperatures, the outer seal coat layer 58 may be selected from other sealing materials, one such material being polyvinyl acetate. Preferably, those surfaces of the mold walls 56 which can come into contact with the molten material 72 include inner seal coat layer 59 of one of the aforesaid refractory materials which can withstand the temperatures encountered by the layer 59. Layer 59 also serves to preclude any tendency for the molten material 72 itself to penetrate into the more porous portions of mold walls 56. In addition, the layers 58 and 59 assure that gases will not penetrate the mold walls 56 and enter the mold cavity 52 during pouring and during solidification, thereby assuring soundness in the completed cast article 80. Thus, the lowered pressure established in the mold cavity 52 prior to pouring of the molten material 72 will remain lowered subsequent to pouring and sealing off of the mold cavity 52 by the juxtaposition of the molten material 72 with the porous member 60, and the raising of the pressure in chamber 14, outside the mold 50.

A typical material for porous member 60 is a magnesia stabilized zirconia having a reticulated structure including pores of a pore size small enough to assure that the surface tension of the molten material 72 will support the molten material on the porous member 60, and establish the desired seal, prior to reversing the pressure in the chamber 14 to urge the molten material 72 through the porous member 60. For example, where the molten material is steel, a pore size no larger than about 580 microns has been found suitable. Similarly, where the molten material is aluminum, a pore size no larger than about 420 microns has been found suitable. Other pore sizes are feasible, depending upon the nature of the molten material, as well as other factors. Thus, where the molten material is a metal alloy, pore size is inversely proportional to the metallostatic head and is dependent upon alloy density and wetting characteristics, as well as upon the pressure exerted on the molten material by the pressure in the chamber 14. A maximum pore size of about 580 microns has been found suitable for the casting of a variety of metal alloys, utilizing the method and apparatus of the invention. Other materials found suitable for porous member 60 are woven refractory fabrics and rigid grid-like structures of refractory material. The properties of the selected material for porous member 60 must be such that the porous member 60 will withstand the forces and the temperatures to which the porous member 60 will be subjected during the practice of the process of the invention.

The placement of the porous member 60 within the mold 50 provides an integrated mold structure which may be constructed readily and then placed within the chamber 14 of apparatus 10 for the simplified execution of the method of the invention. The materials and techniques employed in constructing the mold 50 need not depart drastically from the materials and techniques already familiar to those skilled in the art of investment casting in order to gain the advantages of the present invention. Thus, conventional mold materials can withstand the pressures exerted during the filling of the mold cavity 52 under pressure since the raised pressure within chamber 14 will tend to balance the pressure within the mold cavity 52 and resist explosion of the mold 50. However, mold 50 must be constructed with sufficient strength to resist implosion during the stage of the process when the pressure in the chamber 14 is elevated relative to the lowered pressure in the mold cavity 52 and the mold cavity 52 has not yet been filled with molten material 72.

Figure 5:
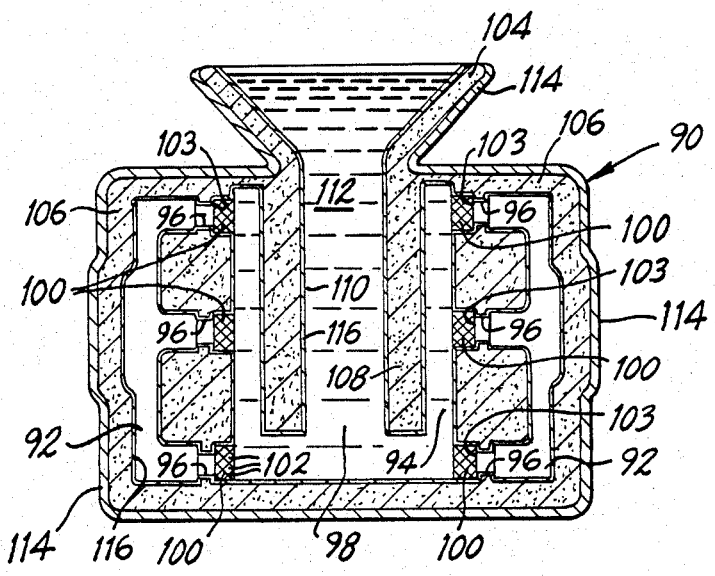
FIG. 5 is a cross-sectional view of an alternative mold in one stage of the method of the invention, illustrating another embodiment.
Figure 6:
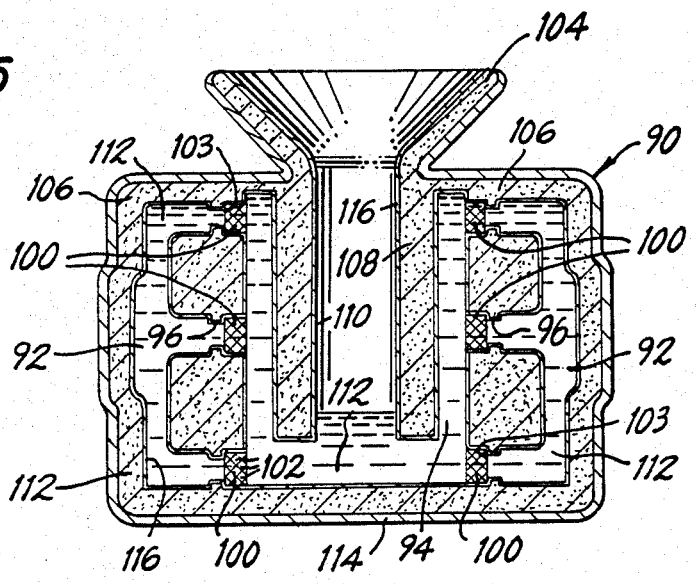
FIG. 6 is a view similar to FIG. 5, illustrating another stage of the method.

Another mold constructed in accordance with the invention is illustrated at 90 in FIGS. 5 and 6. Mold 90 has a mold cavity 92 in the form of a somewhat more complex configuration for the investment casting of a more intricate part. As in the earlier-described embodiment, an inlet conduit 94 interconnects the inside of the mold cavity 92 with the outside of the mold 90; however, in view of the more complex configuration of the mold cavity 92, inlet conduit 94 provides an inlet conduit system which includes a plurality of individual branches 96 extending between a main central portion 98 of the inlet conduit 94 and the mold cavity 92. Porous means is provided in the form of a porous member 100 placed in each individual branch 96, so as to be closely adjacent the mold cavity 92. Each porous member 100 includes a plurality of pores 102 and is fitted into a branch 96, seated against a shoulder 103 in the branch 96, such that all communication between the outside and the inside of the mold cavity 92 is through the pores 102 of the porous members 100. A pouring cup 104 is unitary with the walls 106 of the mold 90 and includes an extension 108 extending downwardly into the central portion 98 of the inlet conduit 94 to form a reservoir 110 for molten material 112 poured into the mold 90 during the process.

As described above, in connection with FIGS. 1 through 3, the process includes placing the empty mold 90 within a pressure chamber where the mold cavity 92 is evacuated, through the passages provided by the pores 102 of the porous members 100, by virtue of the evacuation of the pressure chamber. Subsequently, the molten material 112 is poured into the pouring cup 104 to fill the reservoir 110 and the central portion 98, as seen in FIG. 5. The molten material 112 is juxtaposed with the porous members 100 and is precluded from entering the mold cavity 92 by the surface tension at the interface between the molten material 112 and each porous member 100. At the same time, the molten material 112 seals the branches 96 to close off atmospheric communication between the inside and the outside of the mold cavity 92. As in the earlier-described embodiment, the walls 106 of the mold 90 include layers 114 and 116 of essentially gas-impermeable material to render the walls 106 suitably gas-impermeable Upon raising the pressure in the pressure chamber, the pressure outside the mold cavity 92 is made higher than the pressure inside the mold cavity 92 and the resulting pressure differential is made great enough to force the molten material 112 through the pores 102 of the porous members 100 and into the mold cavity 92 to fill the mold cavity 92, as depicted in FIG. 6. After solidification of the material in the mold cavity 92, the mold 90 is broken away to release the completed casting from the mold 90. The ability to place a plurality of porous members 100 within a corresponding plurality of branches 96, closely adjacent the mold cavity 92, reduces the amount of gating and attains a concomitant reduction in the volume of molten material 112 required for the production of each casting. Moreover, the placement of the plurality of porous members 100 closely adjacent the mold cavity 92 enables the molten material 112 to be brought close to the mold cavity 92 prior to the creation of the pressure differential which will drive the molten material 112 through the porous members 100 and into the mold cavity 92. In addition, the use of multiple porous members 100 tends to retain the filtering ability of each porous member 100 at maximum effectiveness, since all of the molten material 112 which flows into the mold cavity 92 need not pass through a single porous member 100. Thus, mold 90 is better suited for the production of larger parts which require the handling of a greater volume of molten material.

In an example of the above-described process, an aluminum alloy part was cast of aluminum alloy A-201 (formerly known as KO-1). Aluminum alloy A-201 has a melting range between 1060° F. and 1200° F. The mold was constructed by dipping a wax pattern into a zircon predip slurry, then stuccoing with refractory particles, drying, and then dipping into a slurry of powdered refractory and again stuccoing with refractory particles and drying. The process of dipping, stuccoing and drying was repeated until the mold was fully constructed. The mold then was seal coated with a slurry of zircon having a viscosity of 8 to 10, using a Zahn #4 viscosity cup. The coating was baked at 225° F. for one hour to assure that the mold walls were rendered suitably gas-impermeable. A porous member of magnesium stabilized zirconia, having a reticulated structure including 45 pores per linear inch, the pores each having a pore size of about 420 microns, and the porous member having a physical size of two inches by two inches by one-half inch thick, was placed at the base of the pouring cup of the mold after the mold was dewaxed and burned out to free and clean the mold of all wax carbonaceous residue. The porous member was sealed in place using a zircon predip cement, subsequently heated until dry and cured. The alloy was melted in a crucible and the mold was heated to a temperature of 1000° F. Then, both the mold and the crucible of molten alloy were placed in the chamber of the pressure vessel, in appropriate relative position for subsequent pouring, and the chamber was sealed. The chamber then was evacuated to lower the pressure to 4 mm of mercury, the vacuum line was closed, and the level of negative pressure was maintained until the temperature of the molten alloy dropped to 1180° F., just below the liquidus point. At that time the temperature of the mold was 570° F. The molten alloy then was poured into the pouring cup of the mold and onto the porous member, where the molten alloy rested, closing off atmospheric communication between the mold cavity and the chamber outside the mold. Within four seconds after pouring the molten alloy into the pouring cup of the mold, the pressure line was opened, connecting the chamber to an accumulator which provided a source of nitrogen at a pressure of 300 psi. The accumulator and the chamber were of equal volume and within 0.6 seconds the pressure within the chamber was raised to 150 psi. The differential pressure between the chamber and the mold cavity overcame the surface tension which held the molten alloy at rest upon the porous member and urged the molten alloy through the porous member and into the cavity of the mold. The transfer of molten alloy from the pouring cup to the mold cavity commenced upon opening the pressure line and was completed very shortly thereafter, that is, within an estimated time of less than two seconds. The elevated pressure of 150 psi was maintained in the chamber during cooling and solidification of the alloy, a period of fifteen minutes. Upon solidification, the pressure within the chamber was reduced to atmospheric pressure and the mold was withdrawn from the chamber of the vessel and broken away from the casting to release the completed part.

It will be seen that the above-described process and apparatus enable improved filling of a mold cavity through the use of a pressure differential accomplished in a single chamber in a pressure vessel, within which chamber the pressure is first lowered and then raised to attain the desired differential pressure. Thus, the apparatus of the present invention is simplified and economical for widespread use. For economical higher production rates, multiple chambers may be utilized in connection with a single vacuum melting unit. Material is conserved since the mold cavity can be gated almost directly from the pouring cup, thereby eliminating major portions of gating and the added material required for such gating. In addition, the process and apparatus eliminate sources of flaws in the finished castings, thereby increasing the yield of acceptable castings, with a resultant conservation of material. Thus, for example, improved cleanliness arising out of the filtering of unwanted inclusions from the molten material as the molten material enters the mold cavity improves the soundness and quality of the completed casting. Improved mechanical properties are attained as a result of increased soundness. Additionally, the process and the apparatus allow pouring to take place at lower temperatures, even within the melting range of the molten material, for the attainment of a finer grained microstructure and the concomitant advantages of such a microstructure. In this connection, it is noted that where the process is carried out at temperatures low enough to permit the formation of dendrites in the molten material before the molten material is urged to pass through the porous member, the dendrites will be broken up when forced to pass through the pores of the porous member, thereby promoting an enhanced nucleation state, resulting in an ultrafine grain structure in the completed casting. Both the employment of a differential pressure to urge the molten material into the mold cavity and the ability to reduce the temperature gradient between the mold and the molten material contribute to the attainment of the advantageous finer grained microstructures. The retention of pressure on the material in the mold cavity during solidification, as enabled by the porosity of the porous member, is preferable in that such a procedure adds to the soundness and quality of the completed casting.

In addition to the above advantages, the process and apparatus of the invention enable articles of complex and intricate configurations to be produced more economically, thereby reducing the development time required to adapt a particular part for manufacture by casting. Even those configurations which heretofore have been difficult to produce by casting, such as parts having relatively thin-walled sections, now can be manufactured by casting. Thus, casting becomes a competitive process for the production of a wide variety of component parts heretofore manufactured only with more expensive procedures, such as machining, forging and assembling of component elements, such as sheets, by welding. As a consequence, whole new fields of use are opened to castings.

It is to be understood that the above detailed description of embodiments of the invention are provided by way of example only. Various details of procedure, design and construction may be modified without departing from the true spirit and scope of the invention, as set forth in the appended claims.

The embodiments of the invention in which an exclusive property or privilege is claimed are defined is follows:

1. The method of investment casting an article from molten material by filling a cavity in a mold with the molten material for subsequent cooling and then breaking away of the mold for removal of the article from the mold, the mold having mold walls defining the mold cavity, and an inlet conduit system communicating with the mold cavity and through which the molten material is passed to fill the mold cavity, the mold walls being essentially gas-impermeable such that essentially all communication between the inside and the outside of the mold cavity is through the inlet conduit system, the method comprising the steps of:

providing porous means in the inlet conduit system such that atmospheric communication between the inside and the outside of the mold cavity is through the porous means, the porous means having pores small enough to support the molten material by surface tension against passage of the molten material through the porous means;

essentially evacuating the mold cavity through the inlet conduit system and through the pores of the porous means to thereby remove gas from the mold cavity and lower the pressure inside the mold cavity;

subsequently introducing the molten material into the inlet conduit system and juxtaposing the introduced molten material with the porous means so that the molten material rests against the porous means, outside the mold cavity, and essentially closes atmospheric communication between the inside and the outside of the mold cavity; and then raising the pressure outside the mold to establish a pressure outside the mold cavity higher than the pressure inside the mold cavity, while maintaining all atmospheric communication between the inside and the outside of the mold cavity essentially closed, to create a pressure differential between the inside and the outside of the mold cavity at least sufficient to overcome the surface tension and urge the molten material to pass through the pores of the porous means and fill the mold cavity for subsequent cooling and solidification of the molten material and completion of the investment cast article.

2. The invention of claim 1 wherein the molten material is poured onto and is supported against the porous means prior to creating the pressure differential.

3. The invention of claim 1 wherein the molten material is a metal and the porous means includes pores having a pore size no greater than about 580 microns.

4. The invention of claim 1 wherein the higher pressure is in the range of multiple atmospheres.

5. The invention of claim 1 wherein the higher pressure is maintained during solidification and until the molten material is solidified.

6. The invention of claim 1 wherein the higher pressure is established relatively rapidly.

7. The invention of claim 6 wherein the molten material is a metal.

8. The invention of claim 7 wherein the molten metal is poured onto and is supported against the porous means prior to creating the pressure differential.

9. The invention of claim 8 wherein the porous means includes pores having a pore size no greater than about 580 microns.

10. The invention of claim 7 wherein the higher pressure is in the rang of multiple atmospheres.

11. The invention of claim 7 wherein the higher pressure is maintained during solidification and until the molten metal is solidified.

12. The method of investment casting an article from molten material by filling a cavity in a mold with the molten material for subsequent cooling and then breaking away of the mold for removal of the article from the mold, the mold having passages therein providing essentially all of the communication between the inside of the mold cavity and the outside of the mold cavity, the method comprising the steps of:

essentially evacuating the mold cavity through said passages;

subsequently introducing the molten material into the mold and retaining the introduced molten material juxtaposed with said passages outside the mold cavity with a retaining force sufficient to maintain the molten material outside the mold cavity and in such juxtaposition with the passages that the molten material itself closes essentially all atmospheric communication between the inside and the outside of the mold cavity; and then raising the pressure outside the mold to establish a pressure outside the mold cavity higher than the pressure inside the mold cavity, while maintaining all atmospheric communication between the inside and the outside of the mold cavity essentially closed, to create a pressure differential between the inside and the outside of the mold cavity at least sufficient to overcome the retaining force and urge the molten material through at least some of said passages to pass into and fill the mold cavity for subsequent cooling and solidification of the molten material and completion of the investment cast article.

13. The invention of claim 12 wherein the mold has an inlet conduit system communicating with the mold cavity and through which the molten material is passed to fill the mold cavity, the passages communicate with the inlet conduit system, and the step of introducing the molten material into the mold includes the step of introducing the molten material into the inlet conduit system.

14. The invention of claim 12 wherein the higher pressure is in the range of multiple atmospheres.

15. The invention of claim 12 wherein the higher pressure is maintained during solidification and until the molten material is solidified.

16. Apparatus for investment casting an article from molten material by filling a cavity in a mold with the molten material for subsequent cooling and then breaking away of the mold for removal of the article from the mold, the mold having passages therein providing essentially all of the communication between the inside of the mold cavity and the outside of the mold cavity, the apparatus comprising:

means for essentially evacuating the mold cavity through said passages;

means for subsequently introducing the molten material into the mold, means for retaining the introduced molten material juxtaposed with said passages outside the mold cavity with a retaining force sufficient to maintain the molten material outside the mold cavity and in such juxtaposition with the passages that the molten material itself closes essentially all atmospheric communication between the inside and the outside of the mold cavity; and means for then raising the pressure outside the mold to establish a pressure outside the mold cavity higher than the pressure inside the mold cavity, while maintaining all atmospheric communication between the inside and the outside of the mold cavity essentially closed, to create a pressure differential between the inside and the outside of the mold cavity at least sufficient to overcome the retaining force and urge the molten material through at least some of said passages to pass into and fill the mold cavity for subsequent cooling and solidification of the molten material and completion of the investment cast article.

17. The invention of claim 16 wherein the mold has an inlet conduit system communicating with the mold cavity and through which the molten material is passed to fill the mold cavity, the passages communicate with the inlet conduit system, and the means for introducing the molten material into the mold includes means for introducing the molten material into the inlet conduit system.

18. Apparatus for investment casting an article from molten material by filling a cavity in a mold with the molten material for subsequent cooling and then breaking away of the mold for removal of the article from the mold, the mold having mold walls defining the mold cavity, and an inlet conduit system communicating with the mold cavity and through which the molten material is passed to fill the mold cavity, the mold walls being essentially gas-impermeable such that essentially all communication between the inside and the outside of the mold cavity is through the inlet conduit system, the apparatus comprising:

porous means located in the inlet conduit system such that atmospheric communication between the and the outside of the mold cavity is through the porous means, the porous means having pores small enough to support the molten material by surface tension against passage of the molten material through the porous means;

means for essentially evacuating the mold cavity through the inlet conduit system and through the pores of the porous means to thereby lower the pressure inside the mold cavity;

means for subsequently introducing the molten material into the inlet conduit system and juxtaposing the introduced molten material with the porous means so that the molten material rests against the porous means, outside the mold cavity, and essentially closes atmospheric communication between the inside and the outside of the mold cavity; and means for then raising the pressure outside the mold to establish a pressure outside of the mold cavity higher than the pressure inside the mold cavity, while maintaining all atmospheric communication between the inside and the outside of the mold cavity essentially closed, to create a pressure differential between the inside and the outside of the mold cavity at least sufficient to overcome the surface tension and urge the molten material to pass through the pores of the porous means and fill the mold cavity for subsequent cooling and solidification of the molten material and completion of the investment cast article.

19. The invention of claim 18 wherein the porous means is located closely adjacent the mold cavity.

20. The invention of claim 19 wherein the porous means comprises a porous member and said passages comprise pores in the porous member.

21. The invention of claim 18 wherein the porous means includes at least one porous member, the molten material is a metal and the means for juxtaposing the molten material with the porous member includes means for pouring the molten metal onto the porous member such that the molten metal is supported upon the porous member prior to establishing the pressure differential.

22. The invention of claim 21 wherein the porous member includes pores having a pore size no greater than about 580 microns.

23. The invention of claim 18 wherein the means for establishing the pressure differential includes a single enclosed chamber within which the mold is placed.

24. The invention of claim 23 wherein the porous means includes at least one porous member, the molten material is a metal and the means for juxtaposing the molten material with the porous member includes means for pouring the molten metal onto the porous member such that the molten metal is supported upon the porous member prior to establishing the pressure differential.

25. The invention of claim 24 wherein the porous member includes pores having a pore size no greater than about 580 microns.

26. The invention of claim 18 wherein the inlet conduit system includes a plurality of branches communicating with the mold cavity and the porous means includes a porous member in each branch.

27. The invention of claim 26 wherein each porous member is located closely adjacent the mold cavity.

* * * * *